US008651630B2

(12) United States Patent
Jilani et al.

(10) Patent No.: US 8,651,630 B2
(45) Date of Patent: Feb. 18, 2014

(54) FLUID EJECTOR STRUCTURE

(75) Inventors: Adel Jilani, Redmond, WA (US); Tony S. Cruz-Uribe, Corvallis, OR (US); Martha A. Truninger, Corvallis, OR (US); Kenneth Michael Kramer, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/133,773

(22) PCT Filed: Jan. 20, 2009

(86) PCT No.: PCT/US2009/031440

§ 371 (c)(1),
(2), (4) Date: Jun. 9, 2011

(87) PCT Pub. No.: WO2010/085239

PCT Pub. Date: Jul. 29, 2010

(65) Prior Publication Data

US 2011/0285794 A1 Nov. 24, 2011

(51) Int. Cl.
*B41J 2/045* (2006.01)

(52) U.S. Cl.
USPC ..... 347/71; 347/70; 347/68; 347/72

(58) Field of Classification Search
USPC ..... 347/68–72
See application file for complete search history.

(56) References Cited

U.S. PATENT DOCUMENTS

| | | | | |
|---|---|---|---|---|
| 4,364,070 | A | 12/1982 | Matsuda et al. | |
| 4,383,264 | A * | 5/1983 | Lewis | 347/68 |
| 6,050,679 | A | 4/2000 | Howkins | |
| 6,132,035 | A | 10/2000 | Kutami et al. | |
| 6,273,552 | B1 | 8/2001 | Hawkins et al. | |
| 6,280,022 | B1 | 8/2001 | Reinten | |
| 6,497,476 | B1 | 12/2002 | Namba et al. | |
| 7,156,493 | B2 * | 1/2007 | Ishikawa | 347/54 |
| 2006/0232641 | A1 | 10/2006 | Sugahara | |

FOREIGN PATENT DOCUMENTS

| | | | |
|---|---|---|---|
| CN | 1445090 | A | 10/2003 |
| DE | 19639717 | A1 | 4/1997 |
| EP | 0563603 | A2 | 10/1993 |
| JP | 01022556 | | 1/1989 |
| JP | 02165959 | | 6/1990 |
| JP | 1994-079871 | | 3/1994 |

(Continued)

OTHER PUBLICATIONS

Supplementary European Search Report for Application No. EP09838989.3. Report issued Aug. 29, 2012.

(Continued)

*Primary Examiner* — Henok Legesse

(57) ABSTRACT

In one embodiment, a fluid ejector structure includes: a chamber for containing a fluid; a flexible membrane forming one wall of the chamber; a plurality of piezoelectric elements; a backing operatively connected to the piezoelectric elements such that an expansion and/or contraction of a piezoelectric element causes the piezoelectric element to bend; a rigid plate overlaying a center portion of the membrane; a post coupling the piezoelectric elements to the plate through the backing such that a movement of each piezoelectric element toward the chamber is transmitted to the plate through the post. The plate is configured to transmit movement of the post to the membrane in a rigid, or substantially rigid, piston-like manner.

13 Claims, 9 Drawing Sheets

(56) References Cited

FOREIGN PATENT DOCUMENTS

| | | | |
|---|---|---|---|
| JP | 06071877 | | 3/1994 |
| JP | 06336011 | | 12/1994 |
| JP | 1995-202284 | | 8/1995 |
| JP | 7266557 | A | 10/1995 |
| JP | 8224874 | A | 9/1996 |
| JP | 09104109 | | 4/1997 |
| JP | 9174836 | A | 7/1997 |
| JP | 1997-323410 | | 12/1997 |
| JP | 2000177121 | | 6/2000 |
| JP | 2003-094655 | | 4/2003 |
| JP | 2005014506 | A | 1/2005 |
| JP | 2008-023929 | | 2/2008 |
| JP | 2008-023930 | | 2/2008 |
| JP | 2008-094002 | | 4/2008 |
| JP | 2008-246789 | | 10/2008 |

OTHER PUBLICATIONS

ISA Search Report and Written Opinion.

* cited by examiner

FLUID EJECTOR STRUCTURE

BACKGROUND

Inkjet printers use a printhead that includes an array of orifices through which ink is ejected on to paper or other print media. Ink filled channels, supplied from a reservoir, feed ink to a firing chamber at each orifice. In a piezoelectric type inkjet printhead, the deformation of a piezoelectric element coupled to one wall of the firing chamber alternately contracts and expands the volume of the firing chamber. During contraction, pressure in the chamber increases and ink is expelled from the chamber through the orifice. During expansion, pressure in the chamber decreases and ink refills the chamber through the channels from the reservoir(s), allowing for repetition of the ink expulsion sequence. One challenge in designing printheads with more dense orifice arrays and correspondingly smaller firing chamber dimension(s) is generating sufficient pressure differentials within the chamber volume to sustain adequate ink expulsion and refill. Thus, it may be desirable in some printhead designs to maximize the volume change in the firing chamber achieved by each deformation of the piezoelectric elements.

DRAWINGS

FIG. 3 is a lengthwise section taken along the line 3-3 in FIG. 2.

FIG. 4 is a crosswise section taken along the line 4-4 in FIG. 2.

FIG. 8 is a lengthwise section view taken along the line 8-8 in FIG. 7.

DESCRIPTION

Embodiments of the present disclosure were developed in an effort to maximize the volume change in a piezoelectric inkjet printhead firing chamber induced by the piezoelectric actuator, thus facilitating the design of printheads with more dense orifice arrays and correspondingly smaller firing chamber dimension(s) while still generating sufficient pressure differentials within the chamber volume to sustain adequate ink expulsion and refill. Embodiments of the disclosure, therefore, will be described with reference to a piezoelectric inkjet ejector structure. Embodiments, however, are not limited to inkjet ejector structures, but may be implemented in other piezoelectric fluid ejector structures. Hence, the following description should not be construed to limit the scope of the disclosure.

Figure 1:
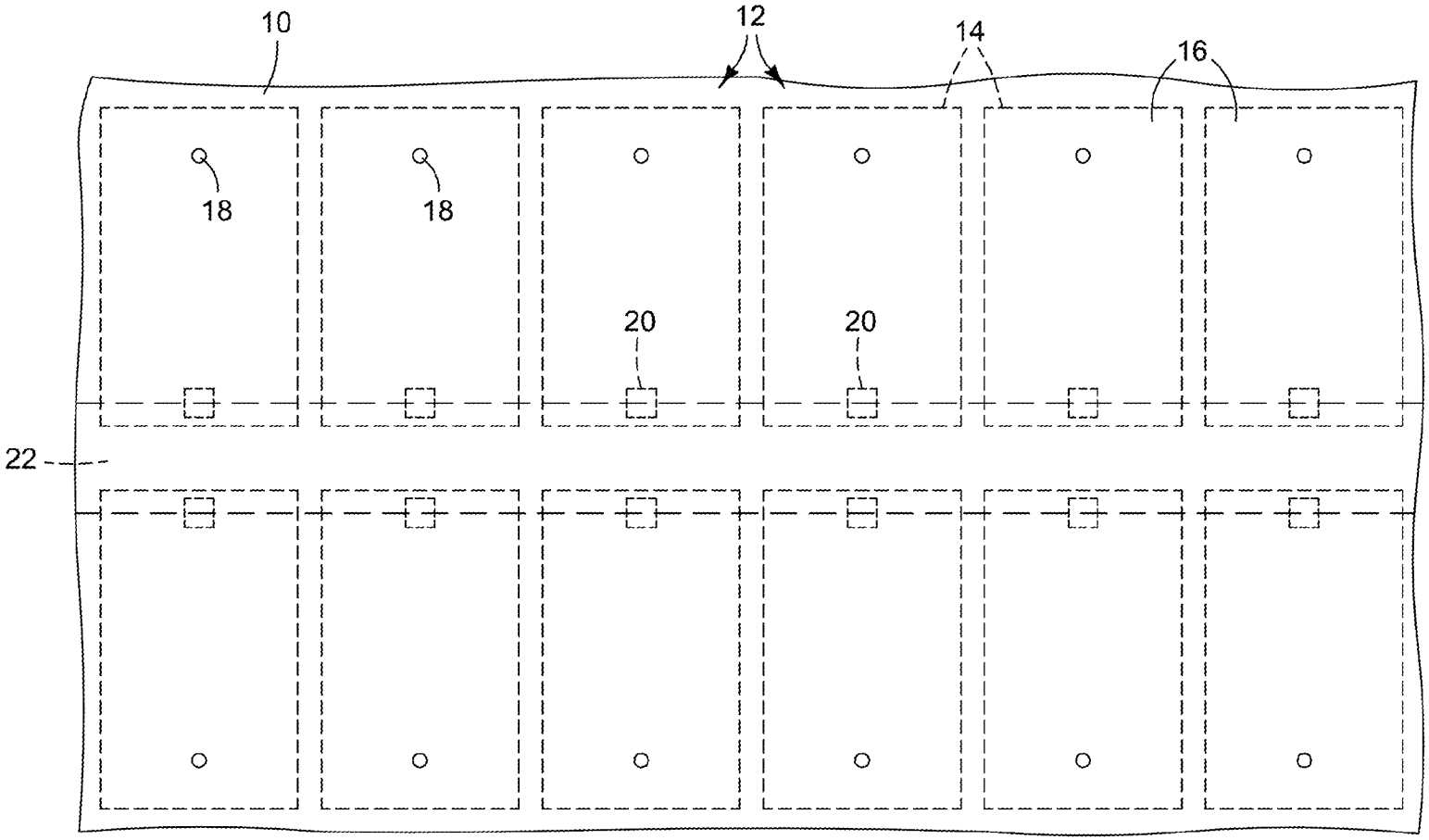
FIG. 1 is a plan view illustrating a portion of one example of a piezoelectric inkjet printhead that includes an array of individual ejector structures.

FIG. 1 is a plan view illustrating a portion of one example of a piezoelectric inkjet printhead 10 that includes an array 12 of individual fluid ejector structures 14. For an inkjet printhead 10, the fluid (ink) dispensed with ejector structures 14 is a liquid, although a small amount of gas, typically air bubbles, may sometimes be present in the ink. While embodiments are not limited to dispensing ink and other liquids, and may include ejector structures for dispensing other fluids, piezoelectric ejector structures such as those disclosed in this document generally are not practical for dispensing fluids composed primarily of gas(es).

Referring to FIG. 1, each ejector structure 14 includes a firing chamber 16, an ink ejection orifice 18 and an ink inlet 20. Ink inlets 20 are coupled to an ink channel 22 that supplies ink to firing chambers 16 from an ink source (not shown). In that portion of printhead 10 shown in FIG. 1, ejector structures 14 are laid out in two columns that are each supplied by a single ink channel 22. A typical piezoelectric printhead 10 may include hundreds of individual ejector structures 14 arrayed in several columns and/or rows fed by multiple ink supply channels 22.

Figure 2:
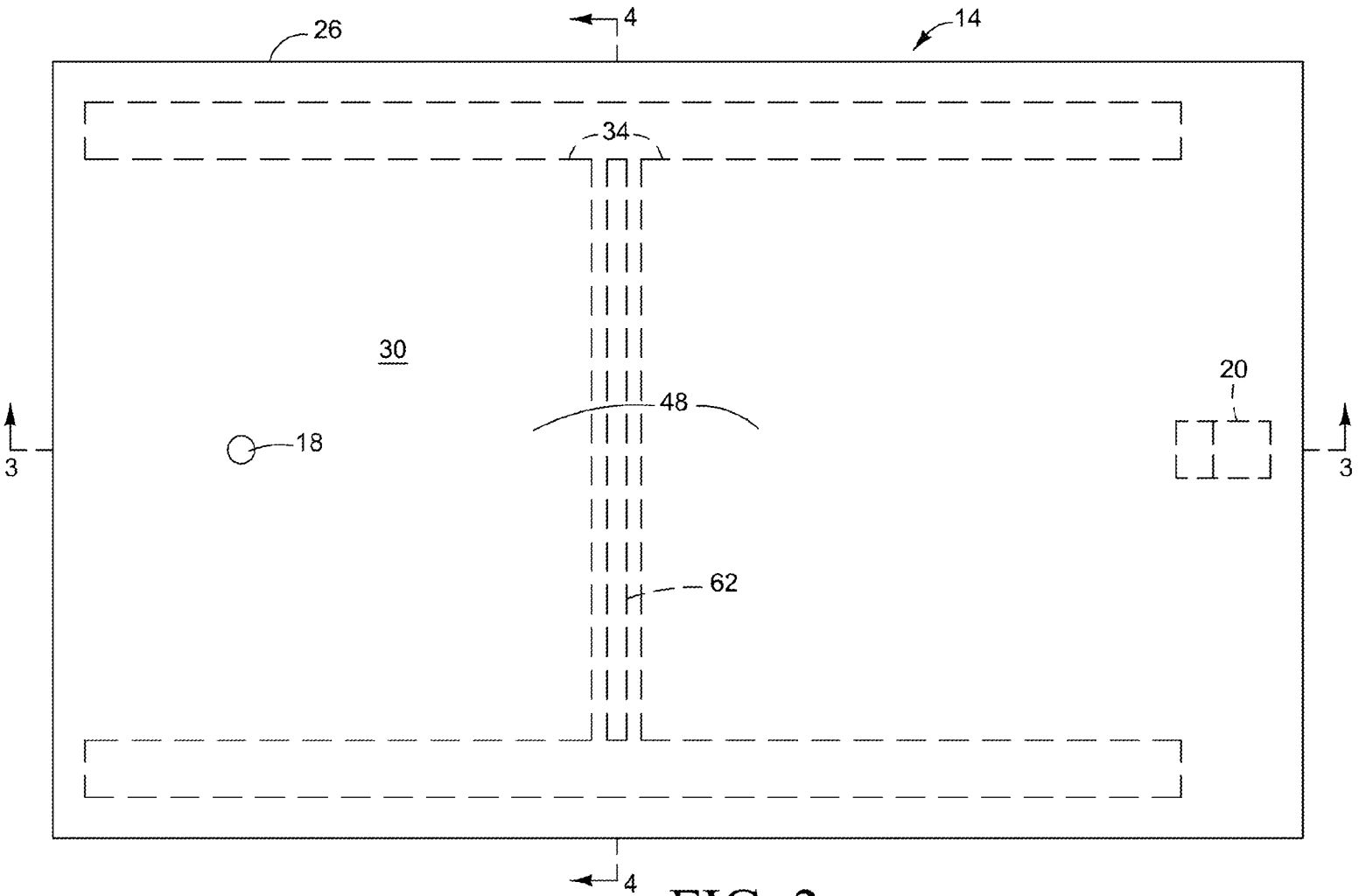
FIG. 2 is a plan view and FIGS. 3 and 4 are elevation section views illustrating a piezoelectric ejector structure configured according to one embodiment of the disclosure.
Figure 3:
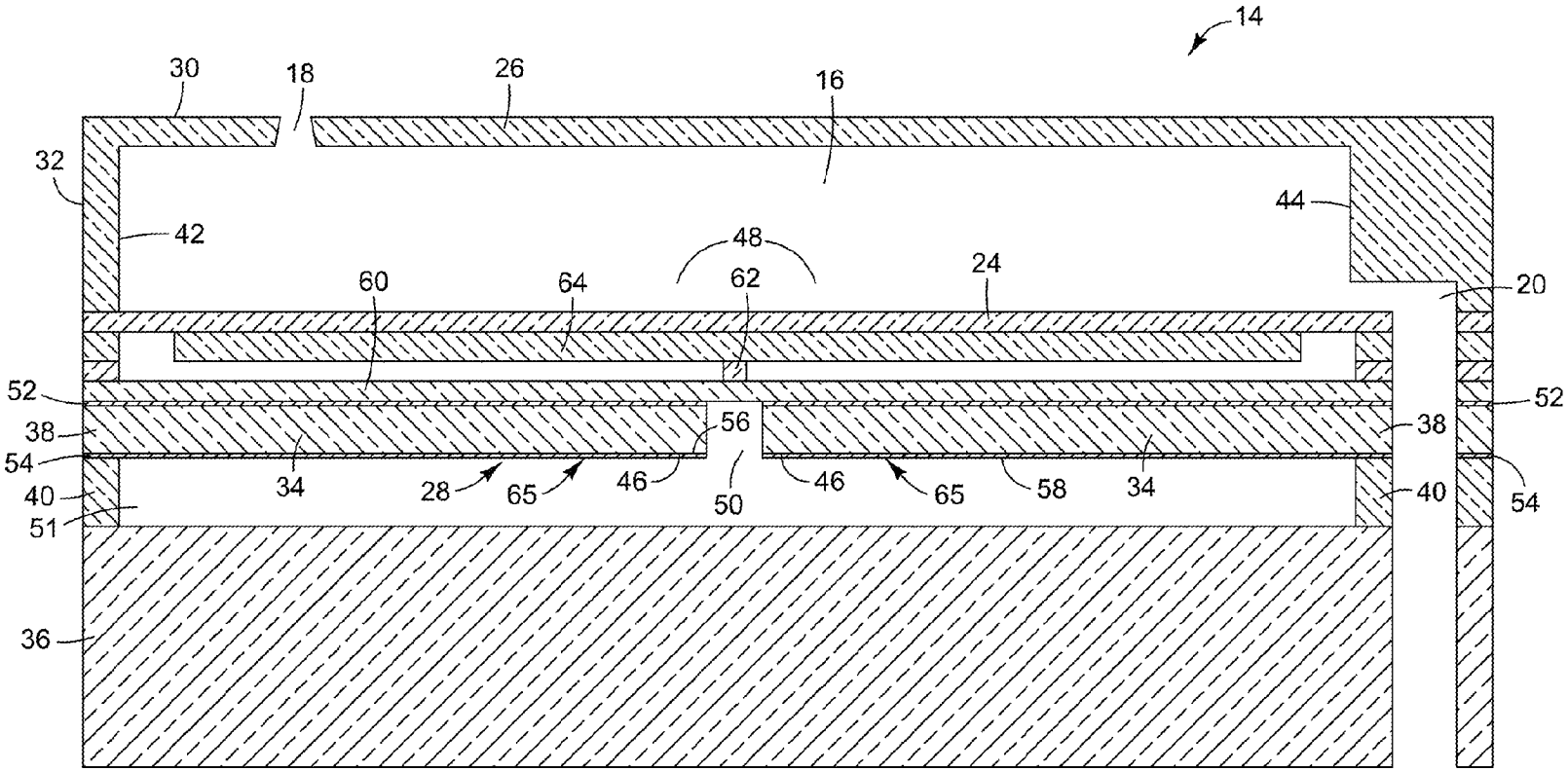
Figure 4:
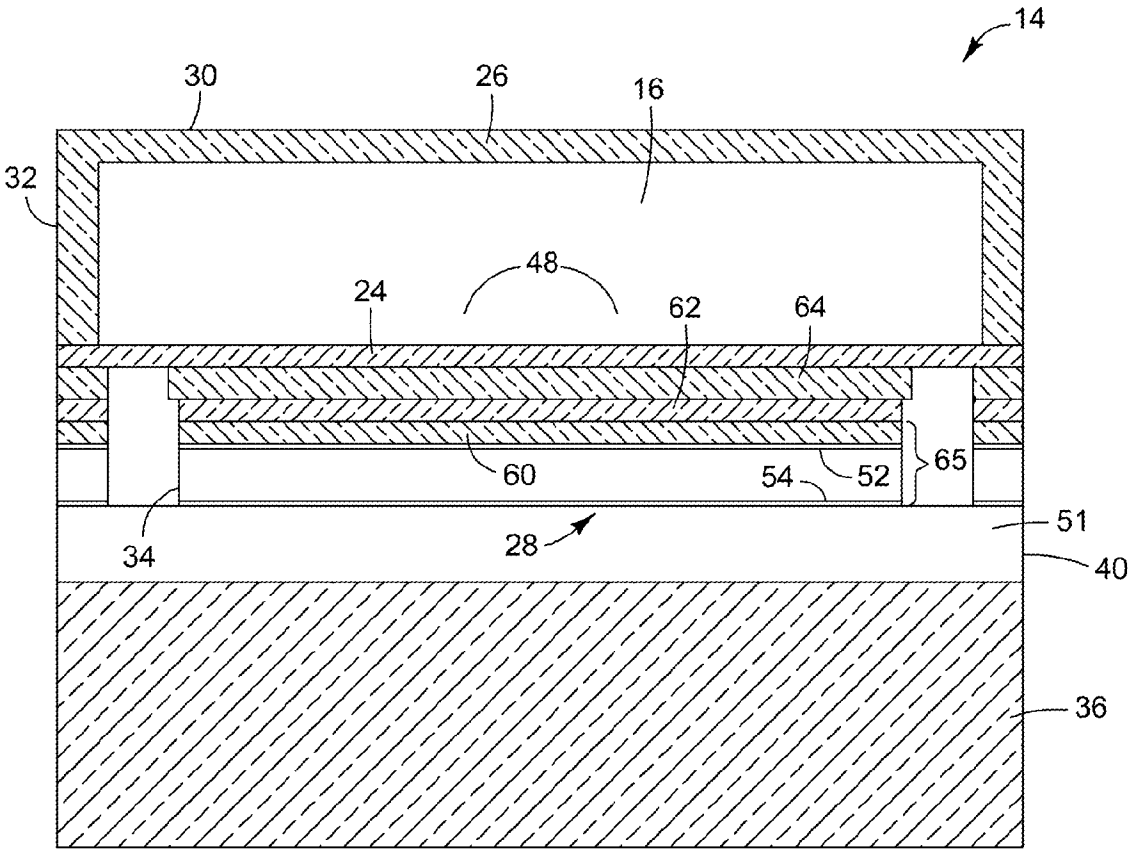

FIG. 2 is a plan view illustrating one example embodiment of an individual piezoelectric ejector structure 14. FIG. 3 is a lengthwise section view of ejector structure 14 taken along the line 3-3 in FIG. 2. FIG. 4 is a crosswise section view of ejector structure 14 taken along the line 4-4 in FIG. 2. Referring to FIGS. 2-4, ejector structure 14 includes a firing chamber 16, an orifice 18 through which ink drops are ejected from chamber 16, and an inlet 20 through which ink may enter chamber 16, for example from a supply channel 22 such as that shown in FIG. 1. Firing chamber 16 is defined by a flexible membrane 24 and a comparatively rigid cap 26 glued or otherwise affixed to membrane 24. As described in more detail below, a piezoelectric actuator 28 coupled to membrane 24 flexes membrane 24 to alternately contract and expand firing chamber 16. During contraction, the pressure in chamber 16 increases and ink is expelled from chamber 16 through orifice 18. During expansion, the pressure in chamber 16 decreases and ink refills chamber 16 through inlet 20.

Ejection orifices 18 are formed in the exposed face 30 of cap 26. Cap 26, which is commonly referred to as an "orifice plate" or a "nozzle plate," is usually formed in a silicon or metal sheet, although other suitable materials or configurations may be used. Membrane 24 may be formed, for example, on the underlying structure as a comparatively thin oxide layer. As an alternative to the "face shooter" shown in the figures, in which ejection orifices 18 are formed in face 30 of orifice plate 26, a so-called "edge shooter" could be used in which ink ejection orifices 18 are formed in an exposed edge 32 of orifice plate 26. Also, although the elements of only a single ejector structure 14 are shown and described in detail, the components of many such ejector structures 14 are typically formed simultaneously on a single wafer or on continuous sheets of substrate materials, along with the associated drive and control circuitry, and individual printhead dies 10 (FIG. 1) subsequently cut or otherwise singulated from the wafer or sheets. Conventional techniques well known to those skilled in the art of printhead fabrication and semiconductor processing may be used to make and assemble printhead structures 14. Thus, details of those techniques are not included in this description.

With continued reference to FIGS. 2-4, piezoelectric actuator 28 includes a pair of cantilever piezoelectric plates 34 formed over a silicon or other suitable substrate 36. Piezoelectric plates 34 are formed with a piezoelectric ceramic or other suitable piezoelectric material. The fixed end 38 of each piezoelectric plate 34 is supported on a wall 40 formed on substrate 36 along each end 42, 44 of firing chamber 16. The free end 46 of each piezoelectric plate 34 extends lengthwise to a center part 48 of chamber 16, leaving a gap 50 between plate free ends 46 and a gap 51 between each plate 34 and substrate 36. Metal or other suitable conductors 52, 54 are formed on the opposing faces 56, 58 of piezoelectric plates 34. Conductors 52 and 54, which are commonly referred to as electrodes, carry the electrical signals that induce the desired deformation in the piezoelectric material in plates 34.

Piezoelectric plates 34 are coupled to chamber membrane 24 through a flexible backing 60, a rigid post 62, and a rigid pusher plate 64. (For clarity, only piezoelectric plates 34 and post 62 are shown in the plan view of FIG. 2.) Flexible backing 60 covers piezoelectric plates 34 and spans gap 50 to form a pair of unimorph, bending piezoelectric cantilevers 65 operatively coupled together through a shared inactive layer (backing) 60. A unimorph is a cantilever that consists of one active layer and one inactive layer, piezoelectric plates 34 and backing 60, respectively, in the embodiment shown. The deformation of piezoelectric plates 34 induced by the application of an electric field results in a bending displacement of cantilevers 65. Thus, backing 60 is glued or otherwise operatively connected to piezoelectric plates 34 to cause cantilevers 65 to bend when plates 34 expand or contract lengthwise. In the embodiment shown, backing 60 transmit this bending motion to post 62 at gap 50. Also, if electrodes 52 are held at different electric potentials from one another, then backing 60 should be formed from a dielectric material.

A single elongated post 62 interposed between backing 60 and pusher 64 extends laterally across chamber 16 at free ends 46 of cantilever piezoelectric plates 34 such that post 62 transmits the movement of plates 34 toward chamber 16 to pusher plate 64 along a line extending laterally across chamber 16. For the bending cantilever plates 34 shown in FIGS. 2-4, the greatest displacement occurs at free ends 46. A single elongated post 62 positioned along free ends 46 as shown, therefore, may be used to receive and transmit maximum displacement from both plates 34. A rigid pusher plate 64 transmits the movement and distributes the lifting force of post 62 across membrane 34 in a rigid, or near rigid, piston-like manner that helps maximize the displacement of membrane 34 into chamber 16.

Other configurations are possible. For example, a series of discrete transmission posts 62 extending laterally across chamber 16 at cantilever ends 46 may provide a suitable alternative to a single elongated post 62 for some applications. For another example, where a smaller displacement of membrane 24 (and a corresponding smaller volume change in firing chamber 16) is desired, a narrower transmission post 62 and/or a less expansive pusher plate 64 may be appropriate. If the expanse of pusher 64 is too great, extending too close to the perimeter of membrane 24, the strain at the perimeter of membrane 24 may be large enough to cause a material failure in membrane 24. On the other hand, shrinking the expanse of pusher 64 away from the perimeter of membrane 24 reduces the displacement of membrane 24 and the corresponding volume and pressure changes in chamber 16. Also, the relatively larger uncovered perimeter area of membrane 24 acts as a compliance to absorb the fluid displaced above pusher 64. For a thin film membrane 24 on the order of 1 μm thick, such as might be used in a piezoelectric ejector structure 14, the strain in membrane 24 should be kept below a few percent to prevent fatigue failure. Thus, the thickness and perimeter area of membrane 24 not covered by pusher 64 should be selected to keep the strain in membrane 24 below the fatigue threshold while ensuring the compliance is not large enough to diminish the pressure in chamber 16.

Figure 5:
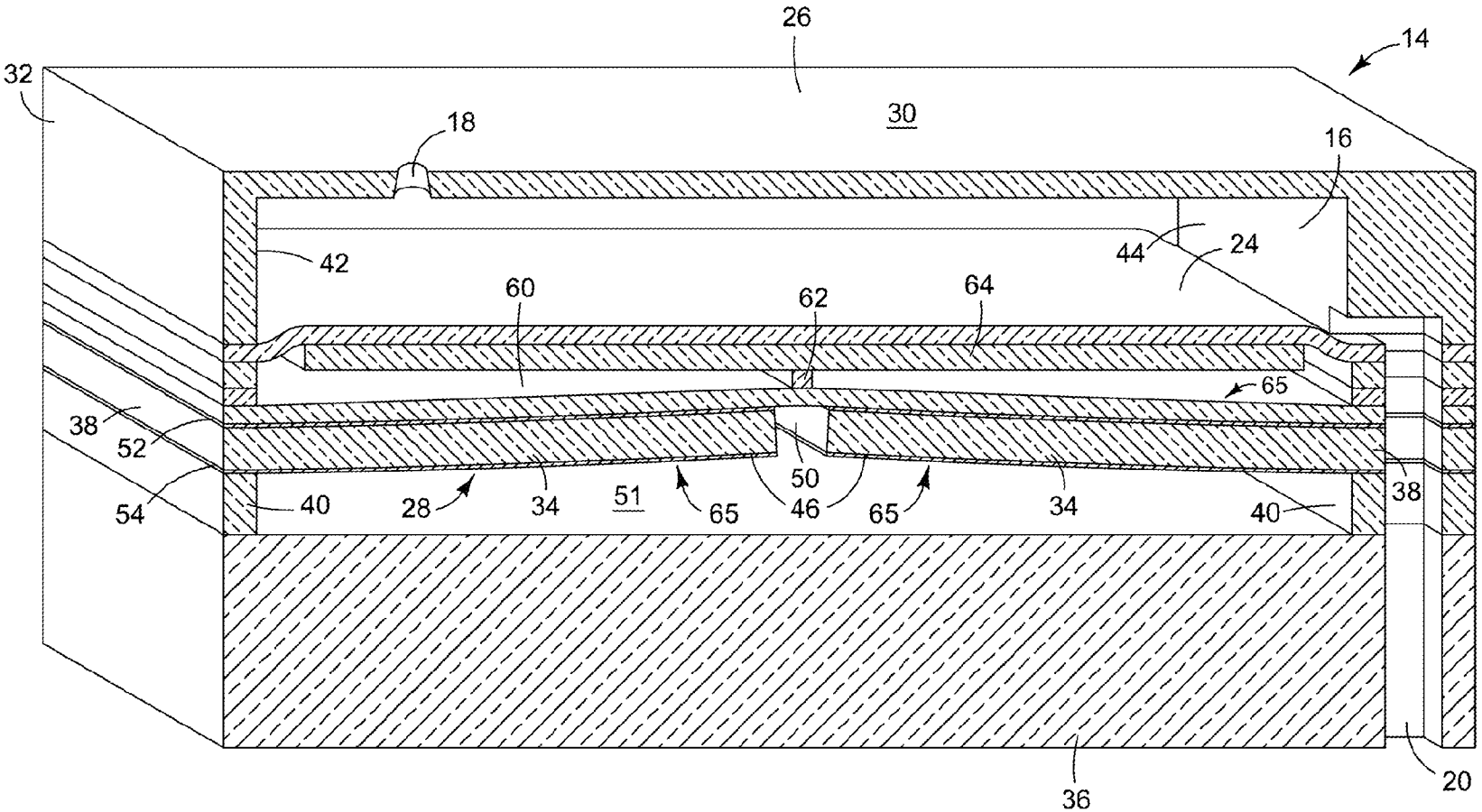
FIG. 5 is a perspective section view of the ejector structure of FIGS. 2-4 showing deformation of the piezoelectric element and the resulting contraction of the firing chamber volume.

FIG. 5 is a perspective section view of ejector structure 14 in FIGS. 2-4 showing deformation of piezoelectric plates 34 and the resulting contraction of firing chamber 16. Referring to FIG. 5, electrical signals applied at high frequency to piezoelectric plates 34 through electrodes 52 and 54, and the resulting electric fields induced in the piezoelectric material, cause cantilever plates 34 to bend very rapidly. That is to say, piezoelectric plates 34 vibrate "up" and "down" to alternately contract and expand the volume of chamber 16. During the contraction part of the cycle, as shown in FIG. 5, free ends 46 of the cantilever plates 34 rotate/bend up in a slight arc. The rotation of free ends 46 acting through backing 60 pushes post 62 and pusher plate 64 straight up against membrane 34. That is to say, the rigid post 62 and rigid pusher 64 translate in response to the rotation of cantilever plate ends 46. Accordingly, membrane 34 flexes into chamber 16, reducing/contracting the volume of an ink filled chamber 16 to expel an ink drop from orifice 18. During the expansion part of the cycle, cantilever plates 34 bend back down, allowing membrane 34 to return to it's original, un-flexed position to increase/expand the volume of chamber 16 so that ink may refill chamber 16 in preparation for the next contraction.

"Flexible" and "rigid" as used herein are relative terms whose characteristics are determined in the context of the scale of deformation and movement in the elements of actuator 28 and in membrane 24. Although the actual scale may vary depending on the particular fluid ejector application or environment, it is expected that for a typical inkjet printing application for a ejector structure 14, the movement of the free end 46 of plates 34 will be on the order of tenths of a micro meter, μm ($10^{-7}$ m) and the displaced volume of firing chamber 14 on the order of pico liters, pl ($10^{-12}$l). Thus, it is desirable that backing 60 and membrane 24 are sufficiently flexible for micro meter displacements to allow comparatively free movement of piezoelectric plates 34 without comprising structural integrity. Similarly, post 62 and pusher 64 are sufficiently rigid to transmit fully, or substantially fully, micro meter movement of piezoelectric plates 34. It is expected that piezoelectric plates 34 and backing 60 will usually be configured to have comparable flexibility/stiffness to help ensure sufficient bending in cantilevers 65 in response to deformation of plates 34. The desired degree of flexibility and rigidity may be achieved, for example, through the relative thicknesses of the elements and/or the characteristics of the material used to form those elements.

Piezoelectric plates 34 may be formed, for example, from a high density type 5A or 5H piezoceramic material commercially available from a variety of sources. Backing 60 may be formed, for example, as a layer of silicon oxynitride or another dielectric material with suitable material properties that can be deposited uniformly at low temperature. To help match material stress characteristics and reduce interface constraints, it may be desirable to form post 62 and pusher 64 from the same material, polysilicon for example, or another suitably rigid material. Where the same materials are used, the thickness of each layer may be adjusted to develop the desired performance characteristics for the part. In any event, since the bending stiffness (rigidity) of post 62 and pusher 64 is a cubic function of thickness, thickness has a comparatively greater influence on the bending stiffness of each part. Backing 60, post 62 and pusher 64 may be prefabricated as a thin film stack that is glued to plates 34, for example, or backing, post and pusher layers may be deposited over piezoelectric plates 34 and selectively removed (patterned and etched for example) to form the desired backing 60, post 62 and pusher 64 structures. Also, although post 62 and pusher 64 are depicted as rectilinear structures, other shapes may be possible.

In one example configuration, a rectangular firing chamber 16 approximately 1 mm (1,000 λm) long and 70 μm wide enables an array density of about 300 orifices per inch. For a chamber depth of 30 μm, a volume change in firing chamber 16 on the order of 5-10 pl expels an ink drop through orifice 18. It is expected that the desired volume change in chamber 16 may achieved, for example, with 10 volts applied to piezoelectric plates 34 using a polysilicon post 62 about 0.5 μm thick and a polysilicon plate 64 about 3.0 μm thick where plate 64 covers approximately 80% of the area of membrane 24 within chamber 16. Thus, in the above noted chamber configuration, a 56 μm×984 μm rectangular plate 64 covers 79% of the 70 μm×1,000 μm rectangular membrane 24 (leaving an 8 μm perimeter of membrane 24 surrounding plate 64). Further, in this example, a 3.0 μm silicon oxynitride backing 60 covers 10 μm thick piezoelectric ceramic plates 34. Metal electrodes 52 and 54 typically will be 0.1 μm thick. Gap 51 should be deep enough to minimize or eliminate "squeeze film" damping by the air in gap 51. Gap 51 should also be large enough to dilute water vapor out gassed from chamber 16, keeping the vapor pressure low in gap 51, to help prevent water vapor permeating piezoelectric plates 34. Thus, for a typical configuration for ejector structure 14 such as that described above, gap 51 should be at least 10 μm deep and, if possible, more than 100 μm deep.

Figure 6:
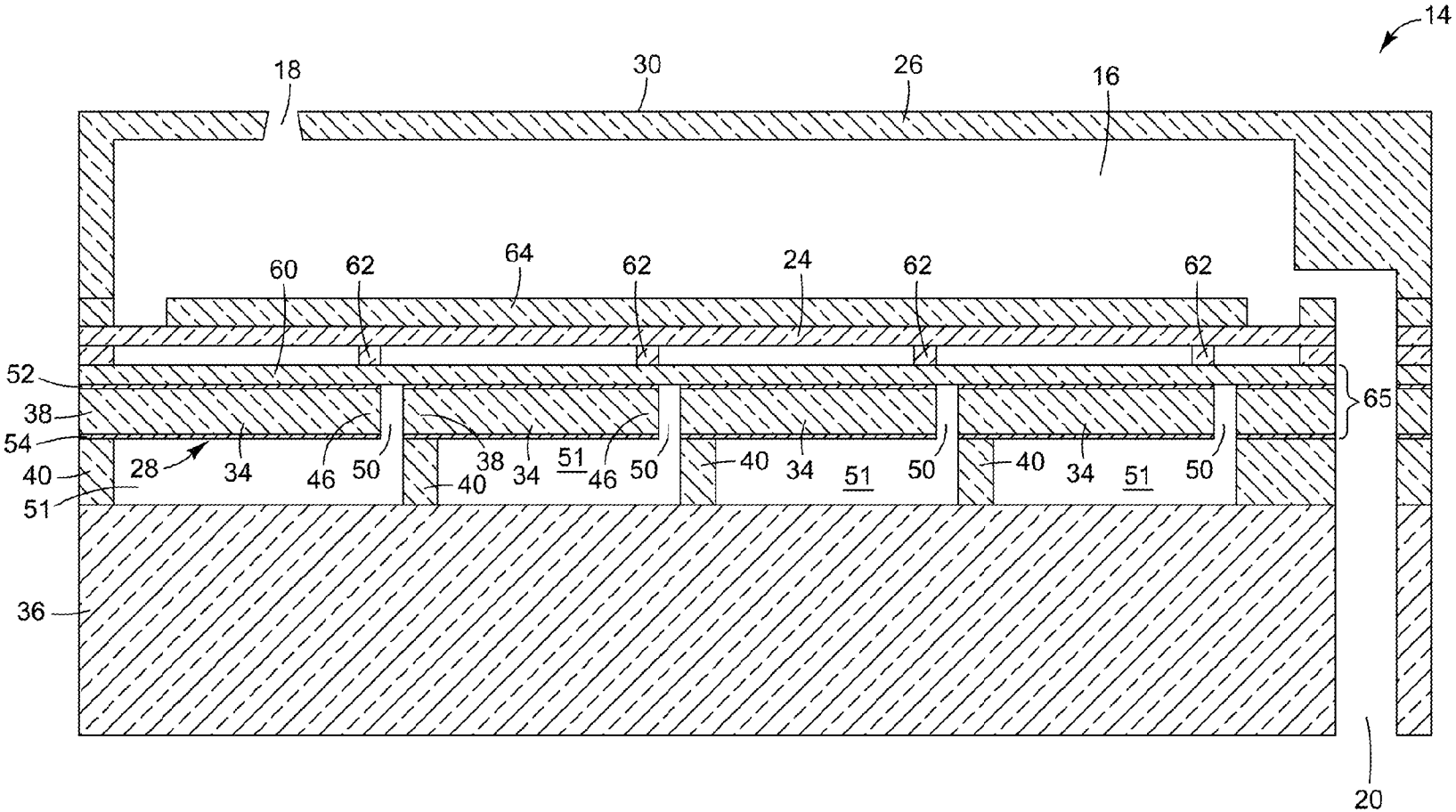
FIG. 6 is an elevation section view illustrating a piezoelectric ejector structure configured according to another embodiment of the disclosure.

FIG. 6 is an elevation section view illustrating another embodiment of a piezoelectric ejector structure 14. In the embodiment shown in FIG. 6, actuator 28 includes a series of four cantilever piezoelectric plates 34 and a corresponding series of four posts 62. The fixed end 38 of each piezoelectric plate 34 is supported on a corresponding series of walls 40. An end wall 40 extends laterally across one end 42 of firing chamber 16. Each interior wall 40 extends laterally across the interior of firing chamber 16. Pusher plate 64 overlays the top of membrane 24 inside chamber 16. Plate 64 may be a discrete element deposited on or otherwise affixed to membrane 24 (as shown) or plate 64 and membrane 24 may be formed as a single integral element in which a thicker plate part is surrounded by a thinner membrane part. Each elongated post 62 is interposed between backing 60 and membrane 24 and extends laterally across chamber 16 at free ends 46 of cantilever piezoelectric plates 34 such that post 62 transmits the movement of each plate 34 toward chamber 16 to pusher plate 64 through membrane 24 along a line extending laterally across chamber 16. In this embodiment, therefore, plate 64 might more accurately be characterized as a "puller" plate that transmits the movement and distributes the lifting force of posts 62 across membrane 34 in a rigid, or near rigid, piston-like manner.

Figure 7:
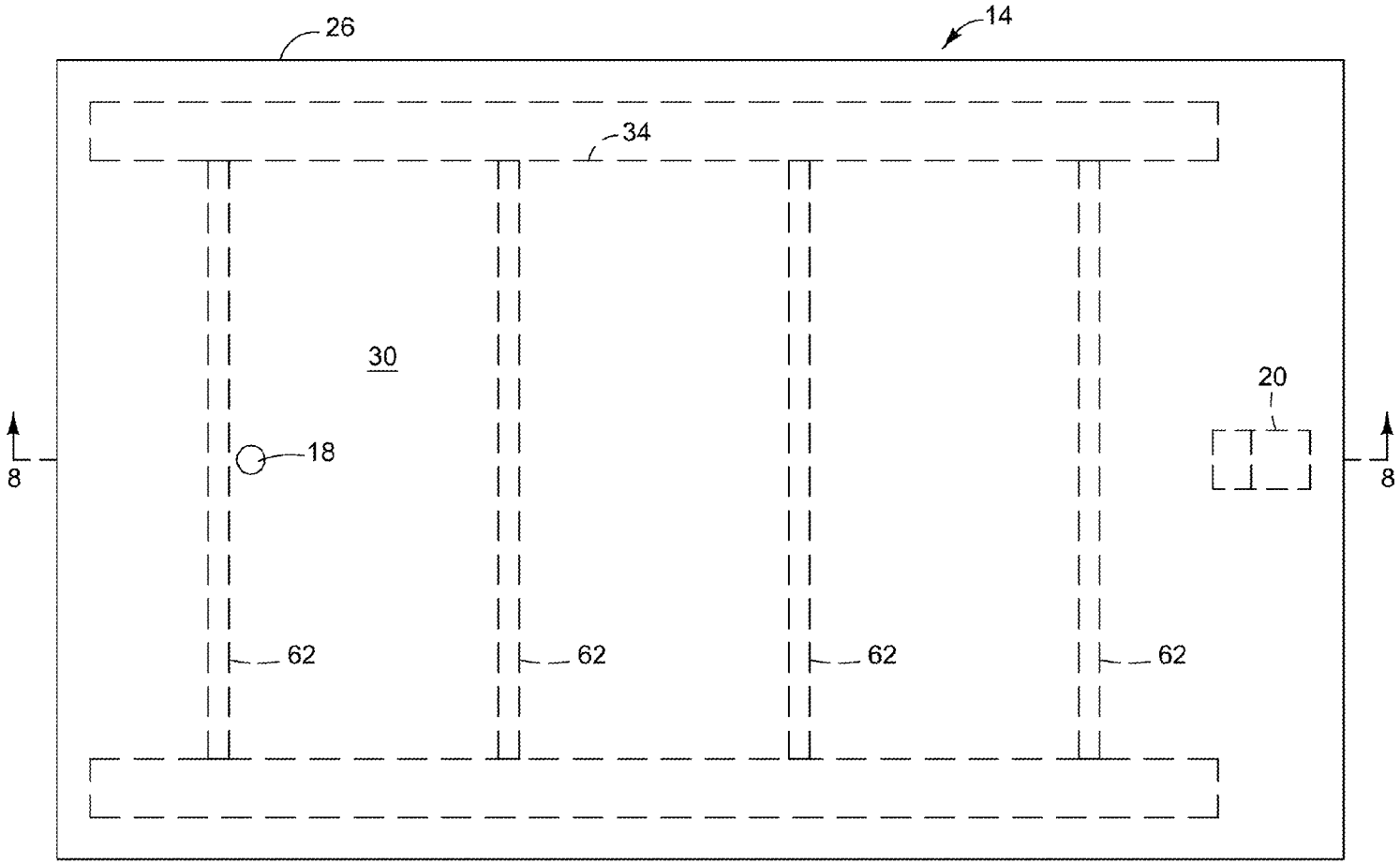
FIGS. 7 and 8 are plan and elevation section views, respectively, illustrating a piezoelectric ejector structure configured according to another embodiment of the disclosure.
Figure 8:
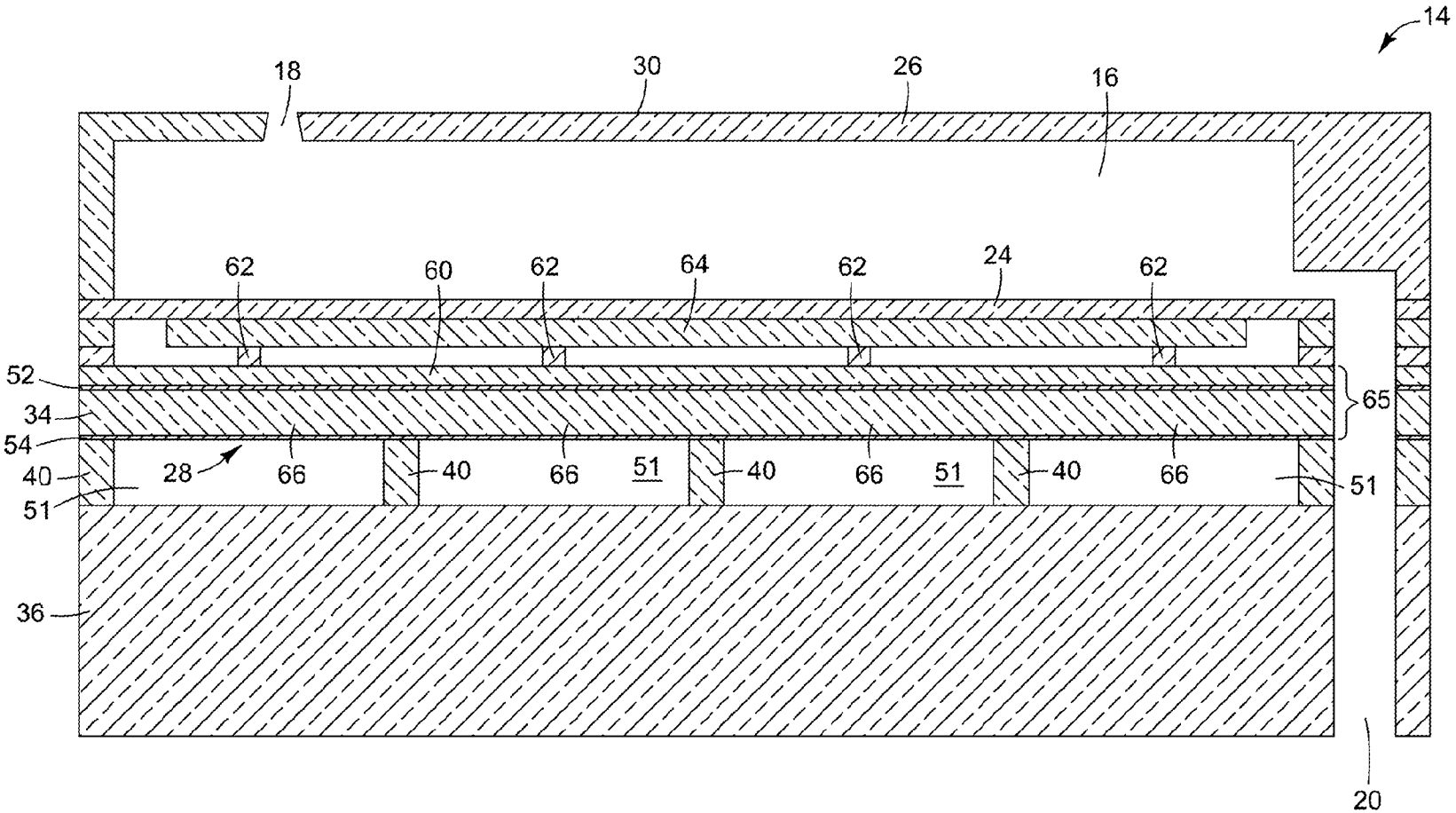
Figure 9:
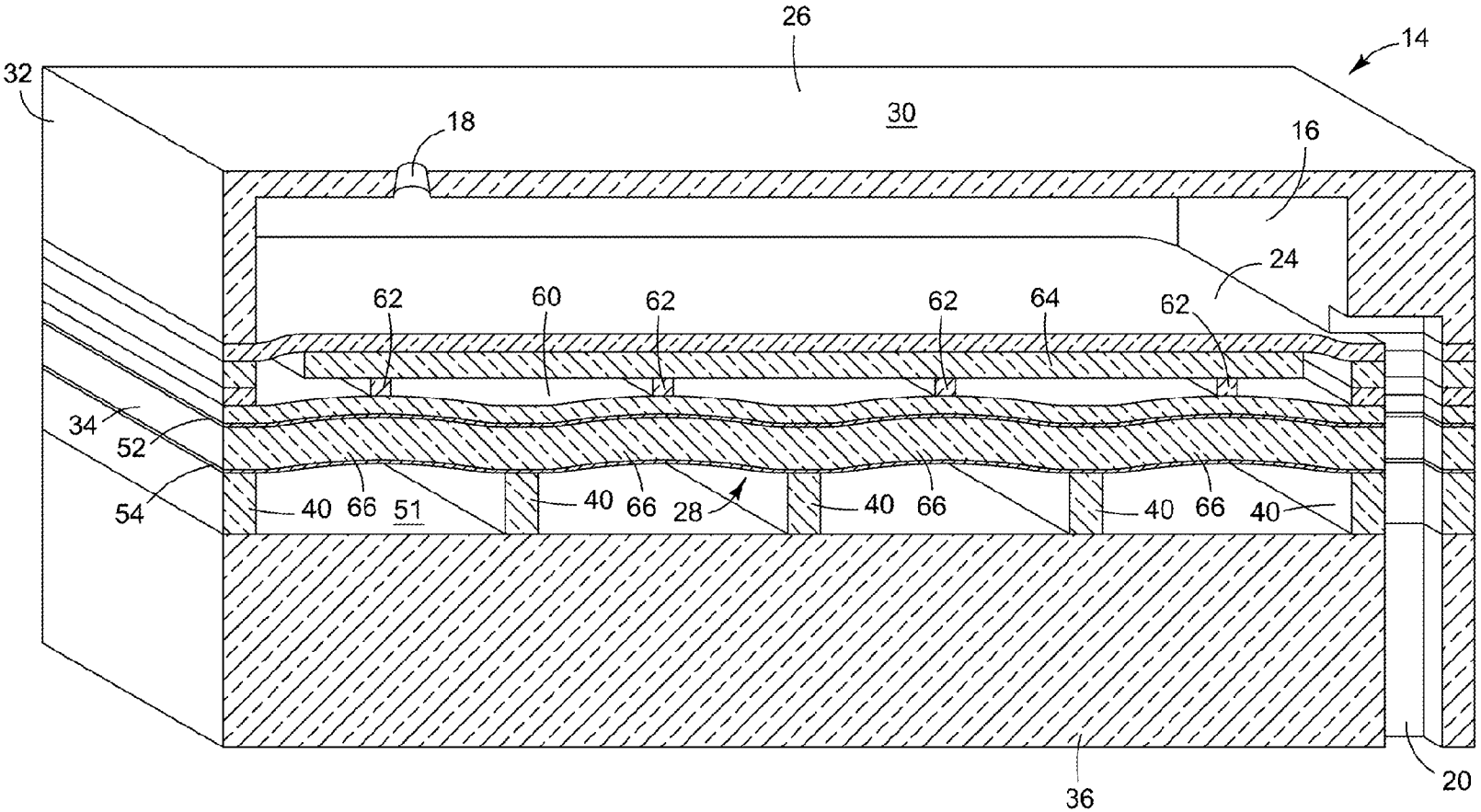
FIG. 9 is a perspective section view of the ejector structure of FIGS. 7 and 8 showing deformation of the piezoelectric element and the resulting contraction of the firing chamber volume.

FIGS. 7 and 8 are plan and elevation section views, respectively, illustrating another embodiment of a piezoelectric ejector structure 14. In the embodiment shown in FIGS. 7 and 8, actuator 28 includes a continuous piezoelectric plate 34 supported on walls 40 and a series of four elongated posts 62 each positioned at the center of one of the four free spans 66 of piezoelectric plate 34. As shown in FIG. 9, electrical signals applied to piezoelectric plate 34 cause each span 66 to bend, flexing membrane 34 through posts 62 and pusher 64 to reduce/contract the volume of chamber 16. Alternatively, a series of discrete piezoelectric plates suspended over gaps 51 between walls 40 could be used to form free spans 66. The formation of discrete piezoelectric plates may require additional processing steps but could provide a greater bending motion at each span 66.

The use of multiple piezoelectric elements means that shorter piezoelectric elements running at higher vibration frequencies, in the range of 1 MHz for example, may be used without regard to the length of the firing chamber since more (or fewer) elements may be incorporated into the piezoelectric actuator for each chamber to achieve both the required volume change and the desired operating frequency. Also, each piezoelectric element is operatively coupled to the chamber membrane by a rigid transmission structure. Thus, the displacement of the piezoelectric element (due to bending or other modes) is transmitted to the chamber membrane in a rigid, or substantially rigid, piston-like manner that helps maximize displacement of the membrane and the corresponding volume change in the firing chamber. This combination of features facilitates the design of piezoelectric printheads with more dense orifice arrays and correspondingly smaller firing chamber dimension(s) while still generating sufficient pressure differentials within the chamber volume to sustain adequate ink expulsion and refill.

As used in this document, no limitation on aspect ratio is intended for a "plate." A "plate" may range from being long and narrow (an aspect ratio much greater or much smaller than 1) to short and wide (an aspect ratio about 1). Also, a "plate" as used herein may be rectilinear (e.g., a rectangle) or curvilinear (e.g., a circle).

No directional limitation is intended from the use of "up" and "down" and other terms indicating directional orientation. Such terms are used herein for convenience only based on the orientation depicted in the figures. The actual orientation may be different from that depicted in the figures. Also, as used in this document, forming one part "over" or "overlaying" or "covering" another part does not necessarily mean forming one part above the other part. A first part formed over, overlaying or covering a second part will mean the first part formed above, below and/or to the side of the second part depending on the orientation of the parts. Also, "over" or "overlaying" or "covering" includes forming a first part on a second part or forming the first part above, below or to the side of the second part with one or more other parts in between the first part and the second part.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector structure, comprising:

a chamber for containing a fluid;

a flexible membrane forming a portion of one wall of the chamber;

a plurality of unimorph piezoelectric cantilevers comprising piezoelectric plates and a backing, the backing operatively connected to the piezoelectric plates such that expansion and/or contraction of the piezoelectric plates causes the piezoelectric cantilevers to bend;

a rigid plate overlaying a center portion of the flexible membrane;

a plurality of elongated posts each extending laterally across the chamber coupling a corresponding one of the unimorph piezoelectric cantilevers to the rigid plate through the backing such that a movement of each unimorph piezoelectric cantilever toward the chamber is transmitted to the rigid plate through the corresponding elongated post along a line extending laterally across the chamber; and the rigid plate is configured to transmit movements of the elongated posts to the flexible membrane in a rigid, or substantially rigid, piston-like manner.

2. The structure of claim 1, wherein the rigid plate and the flexible membrane comprise a single integral element.

3. The structure of claim 1, wherein:

the piezoelectric plates each having a fixed end and a free end extending from the fixed end along part of the chamber;

the plurality of elongated posts each extending laterally across the chamber over a corresponding free end of one of the piezoelectric plates; and the backing comprises a continuous layer of backing material covering the piezoelectric plates and spanning a gap at the free end of each piezoelectric plate such that the movement of each piezoelectric plate toward the chamber is transmitted to the corresponding elongated post through the backing.

4. The structure of claim 1, wherein:

the piezoelectric plates are discrete deformable piezoelectric plates arranged along the chamber;

the plurality of elongated posts each extending laterally across the chamber over a corresponding one of the discrete deformable piezoelectric plates; and the backing comprises a continuous layer of backing material covering the discrete deformable piezoelectric plates such that the movement of each discrete deformable piezoelectric plate toward the chamber is transmitted to the corresponding elongated post through the backing.

5. The structure of claim 4, wherein:

the discrete deformable piezoelectric plates comprises a continuous piezoelectric plate having a plurality of discrete deformable segments arranged along the chamber; and each elongated post extends laterally across the chamber over a corresponding one of the discrete deformable segments.

6. A fluid ejector structure, comprising:

a chamber for containing a fluid, the chamber having an outlet through which fluid is ejected from the chamber and an inlet through which fluid enters the chamber;

a flexible membrane forming a portion of one wall of the chamber;

a plurality of unimorph piezoelectric cantilevers operatively coupled to the flexible membrane for flexing the flexible membrane to change the volume of the chamber and eject fluid from the chamber outlet;

a rigid plate overlaying a center portion of the flexible membrane and configured to transmit a movement of each unimorph piezoelectric cantilever toward the chamber in a rigid, or substantially rigid, piston-like manner; and a plurality of posts each operatively coupling a corresponding one of the unimorph piezoelectric cantilevers to the rigid plate such that the movement of each unimorph piezoelectric cantilever toward the chamber is transmitted to the rigid plate through the corresponding post.

7. The structure of claim 6, wherein all of the unimorph piezoelectric cantilevers share a common inactive layer.

8. The structure of claim 6, wherein the unimorph piezoelectric cantilevers further comprises corresponding piezoelectric plates that are operatively connected to a backing such that an expansion and/or contraction of each of the piezoelectric plate causes the corresponding unimorph piezoelectric cantilever to bend.

9. The structure of claim 8, wherein the plurality of posts each operatively coupling a corresponding one of the unimorph piezoelectric cantilevers to the rigid plate further includes the plurality of posts each coupling a corresponding one of the unimorph piezoelectric cantilevers to the rigid plate through the backing such that the movement of each unimorph piezoelectric cantilever toward the chamber is transmitted to the rigid plate through the corresponding post.

10. A fluid ejector structure, comprising:

a chamber for containing a fluid;

a flexible membrane forming a portion of one wall of the chamber;

a piezoelectric actuator, including:

a plurality of deformable unimorph piezoelectric cantilevers;

a rigid plate overlaying a center portion of the flexible membrane and configured to transmit a movement of each unimorph piezoelectric cantilever toward the chamber in a rigid, or substantially rigid, piston-like manner; and a plurality of posts each coupling a corresponding one of the unimorph piezoelectric cantilevers to the rigid plate, wherein the movement of each unimorph piezoelectric cantilever toward the chamber is transmitted to the rigid plate through the corresponding post and a resulting movement of the rigid plate displaces a volume of the chamber.

11. The structure of claim 10, wherein all of the unimorph piezoelectric cantilevers share a common inactive layer.

12. The structure of claim 10, wherein:

the plurality of unimorph piezoelectric cantilevers comprises corresponding discrete deformable piezoelectric plates arranged along the chamber;

the plurality of posts comprises a plurality of elongated posts each extending laterally across the chamber over a corresponding one of the discrete deformable piezoelectric plates; and a continuous layer of backing material covers the deformable piezoelectric plates such that the movement of each deformable piezoelectric plate toward the chamber is transmitted to the corresponding elongated post through the backing.

13. The structure of claim 12, wherein:

the discrete deformable piezoelectric plates comprises a continuous piezoelectric plate having a plurality of discrete deformable segments arranged along the chamber; and each elongated post extends laterally across the chamber over a corresponding one of the discrete deformable segments.

* * * * *